US005901463A

United States Patent [19]

Guyonnet

[11] Patent Number: 5,901,463

[45] Date of Patent: May 11, 1999

[54] WOOD CURING METHOD

[75] Inventor: René Guyonnet, Saint-Etienne, France

[73] Assignee: N O W (New Option Wood)—societe anonyme, Saintes, France

[21] Appl. No.: 09/043,474

[22] PCT Filed: Jul. 25, 1997

[86] PCT No.: PCT/FR97/01396

§ 371 Date: Mar. 23, 1998

§ 102(e) Date: Mar. 23, 1998

[87] PCT Pub. No.: WO98/04393

PCT Pub. Date: Feb. 5, 1998

[30] Foreign Application Priority Data

Jul. 26, 1996 [FR] France ..... 96/09456

[51] Int. Cl.[6] ..... F26B 7/00

[52] U.S. Cl. ..... 34/396

[58] Field of Search ..... 34/92, 77, 396, 34/389, 382

[56] References Cited

U.S. PATENT DOCUMENTS 5,169,687 12/1992 Sunol ..... 427/297

FOREIGN PATENT DOCUMENTS 0 018 446 11/1980 European Pat. Off. .
0 623 433 11/1994 European Pat. Off. .
2 604 942 4/1988 France .
2 720 969 12/1995 France .

OTHER PUBLICATIONS

Patent Abstract of JP 3111749.

*Primary Examiner*—Henry Bennett
*Assistant Examiner*—Pamela A. Wilson
*Attorney, Agent, or Firm*—Young & Thompson

[57] ABSTRACT

A method for heat-treating wood, including at least one step of maintaining the wood to be treated at a predetermined temperature in a treatment chamber in order to destroy at least partially the hemicellulose of the wood. The method comprises monitoring the current amount of at least one of the gases given off during hemicellulose decomposition throughout the treatment step, and stopping the treatment step once the amount begins to reach a substantially constant value.

7 Claims, 2 Drawing Sheets

WOOD CURING METHOD

CROSS REFERENCE TO RELATED APPLICATION

This is the 35 USC §371 national stage application of international application PCT/FR97/01396 filed on Jul. 25, 1997, which designated the United States of America.

FIELD OF THE INVENTION

The present invention relates to an improvement in methods of treating wood at high temperature and in particular in so-called curing treatments. It also relates to a sensor enabling said method to be carried out.

BACKGROUND OF THE INVENTION

It is known that, in the natural state, wood or the wood fibers which are in contact with a humid atmosphere, tend to be logged with water, going as far as absorbing it up to 100% of their weight. Such water absorption is accompanied, on the one hand, by a swelling and, on the other hand, by a loss of the mechanical qualities and qualities of cohesion of the material which, in certain cases, can go as far as an advanced disintegration thereof. This is why the habit is taken, before every step of machining wood, of effecting a drying step which, by eliminating the water therefrom, improves its dimensional stability.

Although the drying step enables the water to be eliminated from the wood, it in no way modifies the hydrophilic nature thereof, with the result that it is again likely to reabsorb the water eliminated during drying when it is again in a humid atmosphere.

In order to decrease the hydrophilic character of the natural wood and thus to give it a long-lasting dimensional stability, different techniques of heat treatment at high temperature have been proposed.

Among these techniques, it has been proposed to subject the natural wood to different steps of treatment including in particular a drying in open circuit followed by heating and maintenance at a temperature included between about 220° C. and 300° C. for a determined period. Such a technique of treatment, called curing, makes it possible to give the wood both a hydrophobic character and an excellent dimensional stability.

However, it has been ascertained that the operation of curing had to be carried out with the greatest rigour, on pain of decreasing the mechanical characteristics of the wood treated. In fact, it is known that this curing step has for its object to partly destroy the hemicellulose of the wood without being detrimental to the structure thereof, in other words without destroying the lignin.

Under these conditions, one of the major difficulties encountered during the curing treatment consists in determining the time during which the curing temperature must be maintained in order to destroy the hemicellulose without significantly destroying the lignin.

SUMMARY OF THE INVENTION

It is an object of the present invention to overcome this drawback by proposing a method for detecting the end of the treatment level of the curing phase.

The present invention thus has for its object a method of treating wood by heating, comprising at least one step in which the wood to be treated is maintained at a determined temperature so as to destroy at least in part the hemicellulose of the wood, characterized in that it consists in monitoring, all along said step, the existing amount of at least one of the gases resulting from the decomposition of the hemicellulose, and in interrupting this step of treatment as soon as this amount begins to reach a substantially constant value.

In one embodiment of the invention, the wood is disposed in a treatment chamber provided with a sensor sensitive to acetic acid and/or carbon dioxide and/or carbon monoxide.

The present invention also has for an object a sensor intended for carrying out this method of treating wood, characterized in that it comprises a detector element constituted by a metallic oxide of the type allowing the detection of the reducing gases. Interestingly, said metallic oxide is a tin or titanium dioxide.

BRIEF DESCRIPTION OF THE DRAWINGS

An embodiment of the present invention will be described hereinafter by way of non-limiting example, with reference to the accompanying drawings, in which.

DETAILED DESCRIPTION OF THE DRAWINGS

Figure 1:
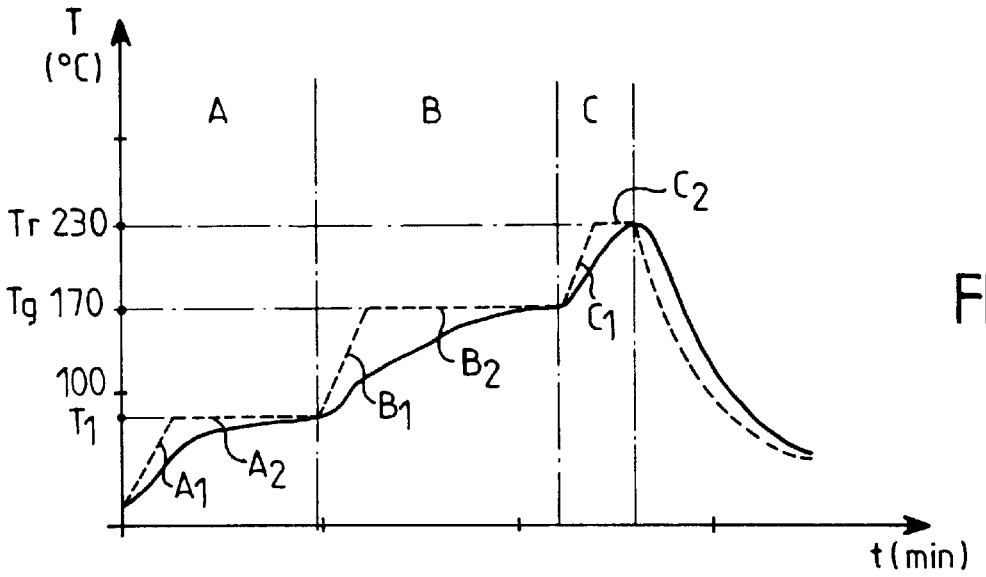
FIG. 1 is a graph which represents the variation of the temperature respectively of a treatment chamber and of the wood to be treated, as a function of time, during a curing treatment.

FIG. 1 thus represents the variation in temperature T (in °C.) as a function of time t (in mins.), to which a chamber containing wood to be treated, constituted by ash, has been taken during a curing process.

Such a process of treatment comprises three steps, namely a drying step A, a glass transition step B, and a curing step proper C.

The first step of drying A is itself divided into two phases, a first phase $A_1$ during which the temperature of the drying chamber containing the ash to be treated is progressively raised, at a temperature-rise speed of about 5° C./min., from the ambient temperature up to a temperature $T_1$ close to 100° C., followed by a phase $A_2$ during which the temperature of the chamber is maintained at the level value $T_1$ until the end of drying.

During the second step B, the temperature of the chamber is progressively raised, at a temperature-rise speed close to the preceding one, from temperature $T_1$ to a temperature $T_g$ of 170° C. close to the glass transition temperature of the essence of wood in question, namely ash in the present case.

The temperature $T_g$ is maintained at this level value for the time necessary for all the mass of wood treated to reach the glass transition temperature $T_g$. It will be noted that the fact of extending the duration of this level is not translated by any detrimental consequence as far as the respect of the mechanical qualities of the product treated is concerned.

During the third step C, the temperature of the chamber is progressively raised, during a phase $C_1$, at a temperature-rise speed close to the preceding speed, from the glass transition temperature $T_g$ of 170° C. up to the curing temperature $T_r$ of 230° C. and the temperature of the oven is maintained during a second phase $C_2$ at this level value, until a large proportion of hemicellulose is decomposed.

It is known that one of the difficulties of this specific phase resides in the fact that the temperature must be maintained for a sufficiently long time for a large percentage of hemicellulose to be decomposed, but that it is imperative not to exceed this time, on pain of beginning to destroy the lignin at the same time, which would then be translated by a drop in the mechanical characteristics of the wood treated.

Figure 2:
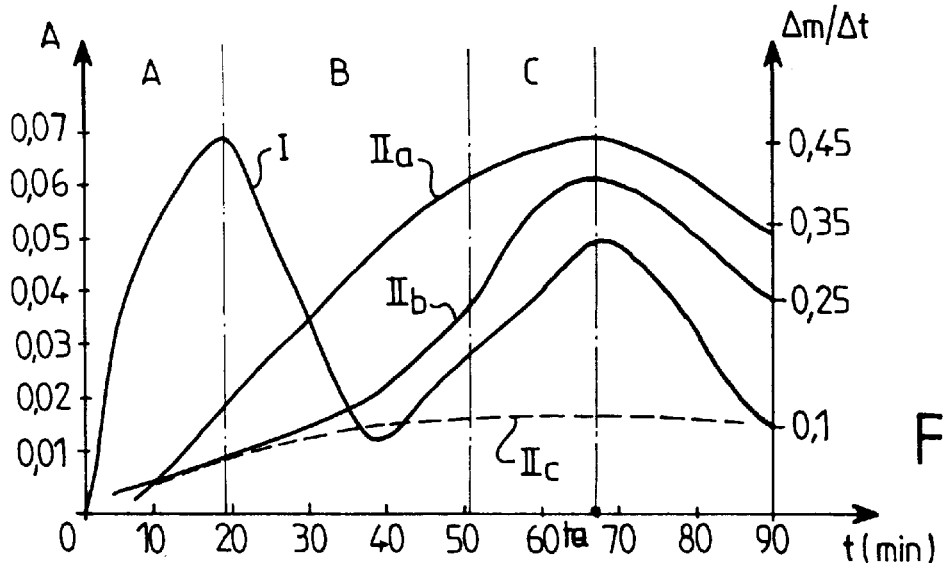
FIG. 2 is a graph which represents, for beech, and as a function of time, on the one hand the variation of absorbance in the infrared of a plurality of the gases which result from decomposition of the hemicellulose and, on the other hand, the variation of loss of mass of the wood treated.

FIG. 2 represents a graph constituted by two series of curves which have been superposed. A first curve (reference I) represents the variation $\Delta m/\Delta t$ of the loss of mass $\Delta m$ of the treated wood as a function of time, during the complete process of curing. A second series of curves represents the variation of absorbance A as a function of time, in the domain of the infrared, during the same process of treatment, characteristic of a release of three gases coming from the decomposition of the hemicellulose, namely acetic acid (curve $II_a$), carbon dioxide (curve $II_b$) and carbon monoxide (curve $II_c$).

Concerning the variation of the mass of the treated wood represented by curve I, the presence of two peaks is observed, which are characteristic firstly of the loss of mass due to the drying of the wood and, secondly, of the loss of mass due to the decomposition of the hemicellulose. It is also observed in this Figure that there is coincidence of the second peak corresponding to the greatest mass drop (curve I) and the three peaks characteristic of the acetic acid (curve $II_a$), carbon dioxide (curve $II_b$) and carbon monoxide (curve $II_c$) produced.

According to the present invention, the amount of one or several of the gases produced by the decomposition of the hemicellulose is monitored, in order to detect the instant $t_a$ which corresponds to the moment when there is no longer any decomposition of the hemicellulose and which therefore indicates that the reaction of curing is terminated.

Such monitoring may be effected by means of sensors of known type which, on the one hand, are able to detect the specific gases produced by the decomposition of the hemicellulose, and in particular acetic acid, carbon dioxide, or carbon monoxide and, on the other hand, are able to withstand the temperatures of the treatment. A plurality of sensors may also be used conjointly, which are each specifically sensitive to one of the gases and of which the signals are processed by electronic means, so as to make a possibly weighted mean of the measurements effected by each sensor. A sensor sensitive to all three gases mentioned above may preferably be used, which simplifies processing of the signal furnished. Of course, to effect monitoring, a gas analysis measuring chain, particularly by infrared spectrography, may also be employed.

Applicants have established that a certain type of sensors is particularly interesting for carrying out the method of treatment according to the invention. The sensors of this type comprise a sensitive element which is constituted by a metallic oxide, and more particularly a metallic oxide of the type allowing detection of the reducing gases. Sensors will thus be more particularly retained whose sensitive element is constituted by tin dioxide. Sensors whose sensitive element is constituted by titanium dioxide or zinc oxide may also be used.

Figure 3:
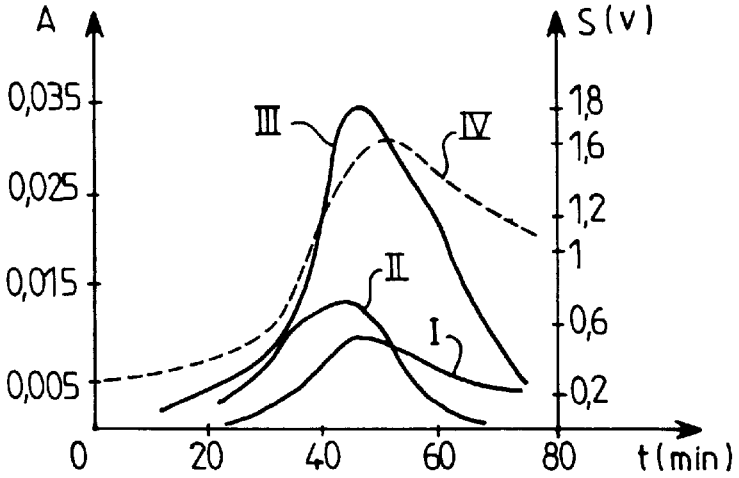
FIG. 3 is a graph which represents, for beech, and as a function of time, on the one hand, the variation of absorbance in the infrared of the above-mentioned gases during a curing step, and, on the other hand, the variation of a signal furnished by a sensor during this step.

FIG. 3 represents, on the same graph, on the one hand, the absorbance A of the acetic acid (curve I), of the carbon dioxide (curve II) and of the carbon monoxide (curve III) during a step of curing proper of pieces of beech and, on the other hand, the signal S in volts (curve IV) produced by a sensor of the prior state of the art which is disposed in the treatment chamber. It is observed in FIG. 3 that the maximum of the signal S furnished by the sensor coincides substantially with the maxima of the curves of absorbance of the acetic acid, carbon dioxide and carbon monoxide, with, however, a sight delay, which makes it possible for the user, when he detects the maximum of the signal S given by his sensor, of being sure that the hemicellulose is indeed decomposed.

An operation of heat treatment of pieces of hornbeam wood which is carried out according to the invention, i.e. by monitoring the end of the phase of curing proper by detecting the moment when the greater part of the hemicellulose is destroyed, will be described hereinafter.

The whole of the treatment comprises a drying step A which is itself followed by a glass transition step B and a curing step C which is monitored according to the invention with a sensor of the type described previously.

Figure 4:
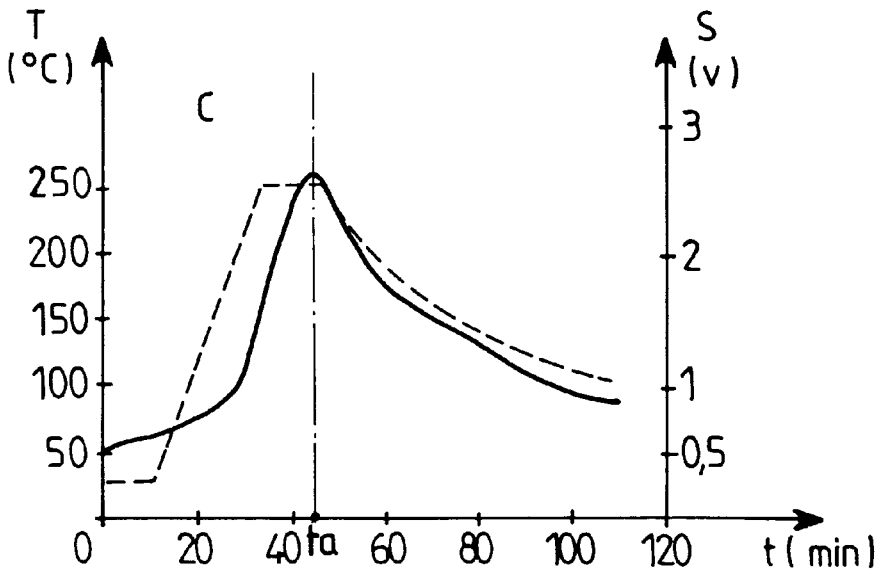
FIG. 4 is a graph which represents, on the one hand, the variation of the temperature of a treatment chamber as a function of time, during a hornbeam wood curing step, and, on the other hand, the variation of a signal furnished by a sensor during this operation.

In FIG. 4, only the step of curing C proper has been represented. There has thus been plotted on the same graph and as a function of time, on the one hand, the variation of the temperature T of the treatment chamber (in broken lines) and, on the other hand, the signal S (in volts) furnished by the sensor (in solid lines). In accordance with the invention, the curing phase proper is stopped at instant $t_a$ when the signal S of the sensor passes through a maximum, i.e. when the heating is interrupted to allow the temperature to drop.

Measurements made on the hornbeam wood thus treated have confirmed that a large part of the hemicellulose is indeed decomposed, which guarantees the efficacity of the curing, and that the lignin is not yet attacked, which guarantees the conservation of the mechanical qualities of the wood treated. These measurements are grouped together in the Table hereinbelow.

The pentosans which represent the majority of the hemicelluloses of this wood have been dosed and it has been observed that, from the natural state to the cured state, the percentage thereof passed from 25.6% to 15.9%, which represents a reduction of 37%.

TABLE

| | Elementary analysis | | | | | |
|---|---|---|---|---|---|---|
| | Carbon (%) | Hydrogen (%) | Oxygen (%) | Pentosans (%) | Lignin (%) | Density (g/cm³) |
| | | | HORNBEAM | | | |
| natural | 47.48 | 6.39 | 46.45 | 25.67 | 17.82 | 0.75 |
| cured | 49.95 | 5.99 | 43.83 | 15.95 | 23.30 | 0.67 |
| | | | PINE | | | |
| natural | 47.62 | 6.35 | 44.75 | 10.70 | 23.04 | 0.55 |
| cured | 51.93 | 5.92 | 42.18 | 3.24 | 25.63 | 0.47 |

The lignins were also dosed and it was observed that there was no destruction thereof, which guarantees the maintenance of the mechanical qualities of the wood treated. It is also observed that the density decreases only slightly, passing from 0.75 to 0.67, which represents a reduction of the order of 10%.

The same treatment was also effected on another essence of wood, namely pine, and the results are shown in the above Table. These results confirm in all points those obtained for the hornbeam.

Interestingly, there may be associated with the sensor electronic signal analysis means which will detect any zero value or any reversal of the slope of the curve representative of the signal S produced during the treatment.

Figure 5:
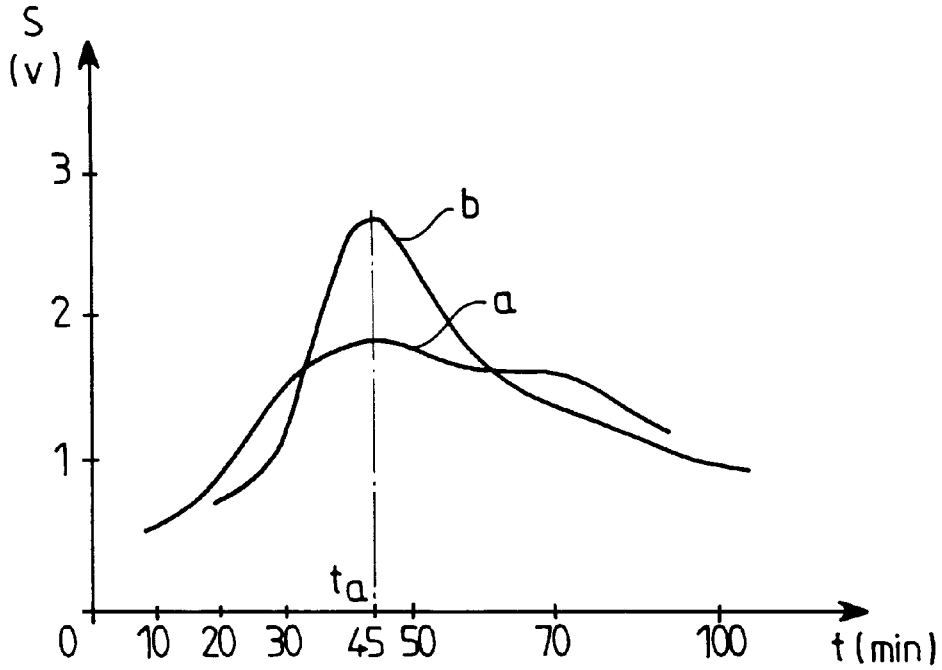
FIG. 5 is a graph which represents the variation of a signal furnished by a sensor as a function of time during a pine wood curing step, on the one hand, and beech wood on the other hand.

Of course, the signal produced by the sensor during the curing phase is a function of the nature of the wood treated. FIG. 5 thus represents the variation of the signal S produced by the same sensor, in the case of a curing treatment effected on pine (curve a) and of the same treatment made on beech (curve b).

It is observed in this Figure that, although the characteristic peak of the respective signals produced by the sensor is less marked in the case of pine than in the case of beech, it is nonetheless easy to detect the cancellation of the slope or its reversal defining the instant $t_a$ when the level of curing must be interrupted.

I claim:

1. Method of treating hemicellulose-containing wood by heating, which comprises:

subjecting the wood to be treated to a curing treatment in a treatment chamber maintained at a determined temperature so as to decompose at least in part the hemicellulose of the wood, and generate gases;

monitoring during the curing treatment the amount of at least one of the gases generated from the decomposition of the hemicellulose; and interrupting the curing treatment as soon as the amount begins to reach a substantially constant value.

2. The method according to claim 1, wherein the gas is selected from the group consisting of acetic acid, carbon dioxide, carbon monoxide,.

3. The method according to claim 1, wherein the amount of gas is detected by a sensor sensitive to at least one of said gases, said sensor being disposed in the treatment chamber.

4. A sensor intended for carrying out the method of treating wood according to claim 3, comprising a detector element constituted by a metallic oxide of the type allowing detection of reducing gases.

5. The sensor according to claim 4, wherein the metallic oxide is selected from the group consisting of tin oxide, titanium oxide, and zinc oxide.

6. The method according to claim 1, wherein the hemicellulose-containing wood is beech.

7. The method according to claim 1, wherein the hemicellulose-containing wood is pine.

* * * * *